US009058767B2

(12) United States Patent
Toyooka

(10) Patent No.: US 9,058,767 B2
(45) Date of Patent: Jun. 16, 2015

(54) ELECTROOPTICAL DEVICE HAVING PIXEL SUBFIELDS CONTROLLABLE TO PRODUCE GRAY LEVELS

(75) Inventor: Takashi Toyooka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 477 days.

(21) Appl. No.: 13/446,824

(22) Filed: Apr. 13, 2012

(65) Prior Publication Data

US 2012/0262501 A1 Oct. 18, 2012

(30) Foreign Application Priority Data

Apr. 18, 2011 (JP) ..... 2011-091941

(51) Int. Cl.
*G09G 3/36* (2006.01)
*G09G 3/20* (2006.01)

(52) U.S. Cl.
CPC ..... *G09G 3/2022* (2013.01); *G09G 3/3648* (2013.01); *G09G 3/3655* (2013.01); *G09G 2300/0434* (2013.01); *G09G 2320/0266* (2013.01)

(58) Field of Classification Search
USPC ..... 345/87, 204, 690
See application file for complete search history.

(56) References Cited

U.S. PATENT DOCUMENTS

| | | | | |
|---|---|---|---|---|
| 2002/0158857 | A1 | 10/2002 | Iisaka | |
| 2003/0137499 | A1 | 7/2003 | Iisaka | |
| 2008/0048942 | A1 | 2/2008 | Ishida et al. | |
| 2010/0225675 | A1* | 9/2010 | Takahashi | 345/690 |
| 2011/0248979 | A1* | 10/2011 | Nishimura | 345/211 |

FOREIGN PATENT DOCUMENTS

| | | | |
|---|---|---|---|
| JP | 2002-287715 | A | 10/2002 |
| JP | 2003-114661 | A | 4/2003 |
| JP | 2003-177723 | A | 6/2003 |
| JP | 2007-108784 | A | 4/2007 |
| JP | 2007-148417 | A | 6/2007 |
| JP | 2008-051949 | A | 3/2008 |
| JP | 2011-059610 | A | 3/2011 |
| JP | 2011-064752 | A | 3/2011 |

* cited by examiner

*Primary Examiner* — Kwang-Su Yang
(74) *Attorney, Agent, or Firm* — Maschoff Brennan

(57) ABSTRACT

An electrooptical device according to the invention includes a plurality of pixels and a driving section that drives the pixel in such a way that the pixel is brought into a bright state or a dark state in each of subfields, and, when a specific gray level is designated, the details of driving of at least one pixel and a pixel adjacent to the one pixel, the details of driving in one frame, are different from each other.

8 Claims, 10 Drawing Sheets

| No. | TIME |
|---|---|
| SF1 | 1.40ms |
| SF2 | 0.90ms |
| SF3 | 0.70ms |
| SF4 | 0.50ms |
| SF5 | 0.32ms |
| SF6 | 0.20ms |
| SF7 | 0.10ms |
| SF8 | 0.05ms |

FIG. 7A

LUT(A)

| GRAY LEVEL | c1 … c8 | c9 … c16 |
|---|---|---|
| 50 | 00111000 | 00011100 |
| 51 | 00111010 | 00011011 |
| 52 | 00111011 | 00011011 |
| 53 | 00111100 | 00011010 |
| 54 | 00111101 | 00011011 |
| 55 | 00111110 | 00011011 |
| 56 | 00111011 | 00110010 |
| 57 | 00111010 | 00110010 |
| 58 | 00111010 | 00110011 |
| 59 | 00111001 | 00110101 |
| 60 | 00111001 | 00110110 |
| 61 | 00111000 | 00111001 |
| 62 | 00111000 | 00111010 |
| 63 | 00110110 | 00111100 |
| 64 | 00110101 | 00111110 |
| 65 | 01100001 | 00111111 |
| 66 | 01100000 | 00111110 |
| 67 | 01100000 | 00111110 |
| 68 | 01100010 | 00111110 |
| 69 | 01100100 | 00111101 |
| 70 | 01100101 | 00111101 |
| 71 | 01100111 | 00111100 |
| 72 | 01101100 | 00111010 |
| 73 | 01101110 | 00111001 |
| 74 | 01101111 | 00111001 |
| 75 | 01110101 | 00111000 |
| 76 | 01110110 | 00110111 |
| 77 | 01111010 | 00110101 |
| 78 | 01111100 | 01100001 |
| 79 | 01111000 | 01100010 |
| 80 | 01111000 | 01100011 |

FIG. 7B

LUT(B)

| GRAY LEVEL | c1 … c8 | c9 … c16 |
|---|---|---|
| 50 | 00111000 | 00011100 |
| 51 | 00111010 | 00011011 |
| 52 | 00111011 | 00011011 |
| 53 | 00111100 | 00011011 |
| 54 | 00111101 | 00011011 |
| 55 | 00111110 | 00011011 |
| 56 | 00111111 | 00011110 |
| 57 | 00111010 | 00110010 |
| 58 | 00111010 | 00110011 |
| 59 | 00111001 | 00110101 |
| 60 | 00111001 | 00110110 |
| 61 | 00111000 | 00111010 |
| 62 | 00111000 | 00111011 |
| 63 | 00110110 | 00111101 |
| 64 | 00110110 | 00111110 |
| 65 | 00111100 | 00111110 |
| 66 | 01100000 | 00111110 |
| 67 | 01100001 | 00111110 |
| 68 | 01100001 | 00111110 |
| 69 | 01100011 | 00111110 |
| 70 | 01100101 | 00111101 |
| 71 | 01100111 | 00111100 |
| 72 | 01101100 | 00111010 |
| 73 | 01101110 | 00111001 |
| 74 | 01101111 | 00111001 |
| 75 | 01110101 | 00111001 |
| 76 | 01110110 | 00110111 |
| 77 | 01111010 | 00110110 |
| 78 | 01111111 | 00110110 |
| 79 | 01111000 | 01100010 |
| 80 | 01111000 | 01100011 |

1: ON DRIVING

0: OFF DRIVING

| | GRAY LEVEL | LUT(A) | LUT(B) |
|---|---|---|---|
| SF CODE | 64 | 0 0 1 1 0 1 0 1 0 0 1 1 1 1 1 0 | 0 0 1 1 0 1 1 0 0 0 1 1 1 1 1 0 |
| | 65 | 0 1 1 0 0 0 0 1 0 0 1 1 1 1 1 1 | 0 0 1 1 1 1 0 0 0 0 1 1 1 1 1 0 |
| | 66 | 0 1 1 0 0 0 0 0 0 0 1 1 1 1 1 0 | 0 1 1 0 0 0 0 0 0 0 1 1 1 1 1 0 |
| | 67 | 0 1 1 0 0 0 0 0 0 0 1 1 1 1 1 0 | 0 1 1 0 0 0 0 1 0 0 1 1 1 1 1 0 |
| TOTAL ON TIME | 64 | 3.27ms | 3.32ms |
| | 65 | 3.52ms | 3.54ms |
| | 66 | 3.42ms | 3.42ms |
| | 67 | 3.42ms | 3.47ms |
| TRANSVERSE ELECTRIC FIELD GENERATION TIME | 64 - 65 | 1.65ms | 0.42ms |
| | 65 - 66 | 0.1ms | 1.92ms |
| | 66 - 67 | 0.0ms | 0.05ms |
| D RISK | 64 - 65 | 46.9% | 11.9% |
| | 65 - 66 | 2.9% | 56.1% |
| | 66 - 67 | 0.0% | 1.4% |

Fig. 8

| | | | |
|---|---|---|---|
| A | B | A | B |
| B | B | B | B |
| A | B | A | B |
| B | B | B | B |

110

FIG. 11A

| | | | |
|---|---|---|---|
| A | B | A | A |
| B | B | B | A |
| A | B | A | A |
| B | B | A | B |

110

FIG. 11B

ELECTROOPTICAL DEVICE HAVING PIXEL SUBFIELDS CONTROLLABLE TO PRODUCE GRAY LEVELS

BACKGROUND

1. Technical Field

The present invention relates to a technique of driving a pixel so as to be turned ON or OFF in each of a plurality of subfields.

2. Related Art

To express halftones in an electrooptical device having display elements such as liquid crystal elements as pixels, a technique using subfield driving has been proposed. The technique using subfield driving is a technique of expressing halftones by driving a pixel so as to be turned ON or OFF in each of a plurality of subfields obtained by dividing a frame (field) and varying the ratio of the ON driving time to the OFF driving time in one frame (for example, JP-A-2007-148417 (Patent Document 1)).

As in the technique described in Patent Document 1, in subfield driving, a subfield code (hereinafter referred to as an SF code) that defines the details of driving (ON or OFF) of the pixels in the subfields of one frame is used. Based on this SF code, an ON voltage or an OFF voltage is applied to the liquid crystal element of each pixel. When the gray levels designated for adjacent pixels are different from each other, in periods of subfields with different details of driving in each SF code, a transverse electric field is generated between the adjacent pixels due to a difference between the ON voltage and the OFF voltage. Owing to the influence of the transverse electric field, disclination is generated between the adjacent pixels and affects display. As a result, the more the subfields with different details of driving in adjacent pixels, the greater the influence of disclination on display, the disclination generated between the adjacent pixels.

Here, to express a large number of gray levels with a small number of subfields, it is necessary to assign weights to the times of the subfields by making the times of the subfields greatly differ from each other. In such a case, the details of driving of long time subfields may differ from each other between the gray levels which are next to each other. The gray levels of adjacent pixels sometimes become the gray levels which are next to each other. However, in the above-described case, the time in which the transverse electric field is generated is also lengthened, and the influence of disclination on display, the disclination generated between the adjacent pixels, becomes greater.

SUMMARY

An advantage of some aspects of the invention is to curb the influence of disclination on display, the disclination caused by a difference between details of driving, even when the details of driving of long time subfields differ from each other between gray levels which are next to each other.

An aspect of the invention provides an electrooptical device including: a plurality of pixels, each having a liquid crystal element; and a driving section that drives the pixel, in accordance with a gray level designated for the pixel, in such a way that the pixel is brought into a bright state or a dark state in each of subfields obtained by dividing one frame, wherein the time of at least one subfield in one frame is different from the times of the other subfields, when a specific gray level is designated for the plurality of pixels, the driving section drives the pixels in such a way that details of driving of at least one pixel and a pixel adjacent to the one pixel, the details of driving in one frame, are different from each other, and the specific gray level is a gray level at which, when a gray level darker than the specific gray level, the gray level next to the specific gray level, changes to the specific gray level, in the details of driving of the one pixel, the longest subfield of the subfields which have changed from the dark state to the bright state coincides with the longest subfield of the subfields whose changed details of driving indicate the bright state, and, in the details of driving of the pixel adjacent to the one pixel, the longest subfield of the subfields which have changed from the dark state to the bright state does not coincide with the longest subfield of the subfields whose changed details of driving indicate the bright state.

With this electrooptical device, even when the details of driving of the long subfields are different from each other between the gray levels next to each other, it is possible to curb the influence of disclination on display, the disclination caused by a difference between the details of driving.

Another aspect of the invention provides an electrooptical device including: a plurality of pixels, each having a liquid crystal element; and a driving section that drives the pixel, in accordance with a gray level designated for the pixel, in such a way that the pixel is brought into a bright state or a dark state in each of subfields obtained by dividing one frame, wherein the time of at least one subfield in one frame is different from the times of the other subfields, when a specific gray level is designated for the plurality of pixels, the driving section drives the pixels in such a way that details of driving of at least one pixel and a pixel adjacent to the one pixel, the details of driving in one frame, are different from each other, and the specific gray level is a gray level at which, when a gray level darker than the specific gray level, the gray level next to the specific gray level, changes to the specific gray level, in the details of driving of the one pixel, the ratio of the sum of the times of the subfields whose details of driving have changed to the sum of the times of the subfields whose changed details of driving indicate the bright state is more than or equal to a predetermined ratio, and, in the details of driving of the pixel adjacent to the one pixel, the ratio of the sum of the times of the subfields whose details of driving have changed to the sum of the times of the subfields whose changed details of driving indicate the bright state is not more than or equal to the predetermined ratio.

With this electrooptical device, even when the details of driving of the long subfields are different from each other between the gray levels next to each other, it is possible to curb the influence of disclination on display, the disclination caused by a difference between the details of driving.

In a preferred aspect, the liquid crystal element is driven in normally black mode, and the time of the bright state in one frame at the specific gray level is determined so as to be longer than the average of the times of the bright state in one frame at a gray level darker than the specific gray level and a gray level brighter than the specific gray level, the gray levels which are next to the specific gray level.

With this electrooptical device, when the same gray level is designated for contiguous pixels in normally black mode, even when the transmittance is decreased as a result of disclination being generated between the contiguous pixels, it is possible to perform display expressing the designated gray level with the pixels as a whole.

In a preferred aspect, the liquid crystal element is driven in normally white mode, and the time of the bright state in one frame at the specific gray level is determined so as to be shorter than the average of the times of the bright state in one frame at a gray level darker than the specific gray level and a gray level brighter than the specific gray level, the gray levels which are next to the specific gray level.

With this electrooptical device, when the same gray level is designated for contiguous pixels in normally white mode, even when the transmittance is decreased as a result of disclination being generated between the contiguous pixels, it is possible to perform display expressing the designated gray level with the pixels as a whole.

In a preferred aspect, the liquid crystal element is driven in normally black mode, and the time of the bright state in one frame at the specific gray level is determined so as to be longer than the time of the bright state in one frame at a gray level brighter than the specific gray level, the gray level next to the specific gray level.

With this electrooptical device, when the same gray level is designated for contiguous pixels in normally black mode, even when the transmittance is decreased as a result of disclination being generated between the contiguous pixels, it is possible to perform display expressing the designated gray level with the pixels as a whole.

In a preferred aspect, the liquid crystal element is driven in normally white mode, and the time of the bright state in one frame at the specific gray level is determined so as to be shorter than the time of the bright state in one frame at a gray level darker than the specific gray level, the gray level next to the specific gray level.

With this electrooptical device, when the same gray level is designated for contiguous pixels in normally white mode, even when the transmittance is decreased as a result of disclination being generated between the contiguous pixels, it is possible to perform display expressing the designated gray level with the pixels as a whole.

In a preferred aspect, the driving section drives the pixels in such a way that the position of the at least one pixel in the plurality of pixels is changed on a frame-by-frame basis or once every two or more frames.

With this electrooptical device, even when the details of driving of long subfields are different from each other between the gray levels which are next to each other, it is possible to curb the influence of disclination on display effectively, the disclination caused by a difference between the details of driving.

In a preferred aspect, when the specific gray level is designated for the plurality of pixels, the driving section drives all the pixels in such a way that the details of driving of one pixel in one frame are different from the details of driving of a pixel adjacent to the one pixel.

With this electrooptical device, even when the details of driving of long subfields are different from each other between the gray levels which are next to each other, it is possible to curb the influence of disclination on display effectively, the disclination caused by a difference between the details of driving.

In a preferred aspect, when the specific gray level is designated for the plurality of pixels, the driving section drives the pixels in such a way that a difference between the time of the bright state in the at least one pixel and the time of the bright state in the pixel adjacent to the one pixel falls within 10% of the sum of the times.

With this electrooptical device, it is possible to perform display expressing the gray level satisfactorily.

BRIEF DESCRIPTION OF THE DRAWINGS

The invention will be described with reference to the accompanying drawings, wherein like numbers reference like elements.

FIGS. 7A and 7B are diagrams explaining the LUTs in the embodiment.

FIG. 8 is a diagram explaining the features of a maximum weight changing section in the embodiment.

FIGS. 11A and 11B are diagrams explaining the LUTs which are applied to the pixels in Modified Example 2.

DESCRIPTION OF EXEMPLARY EMBODIMENTS

Embodiment

Configuration of a Projector 2000

Figure 1:
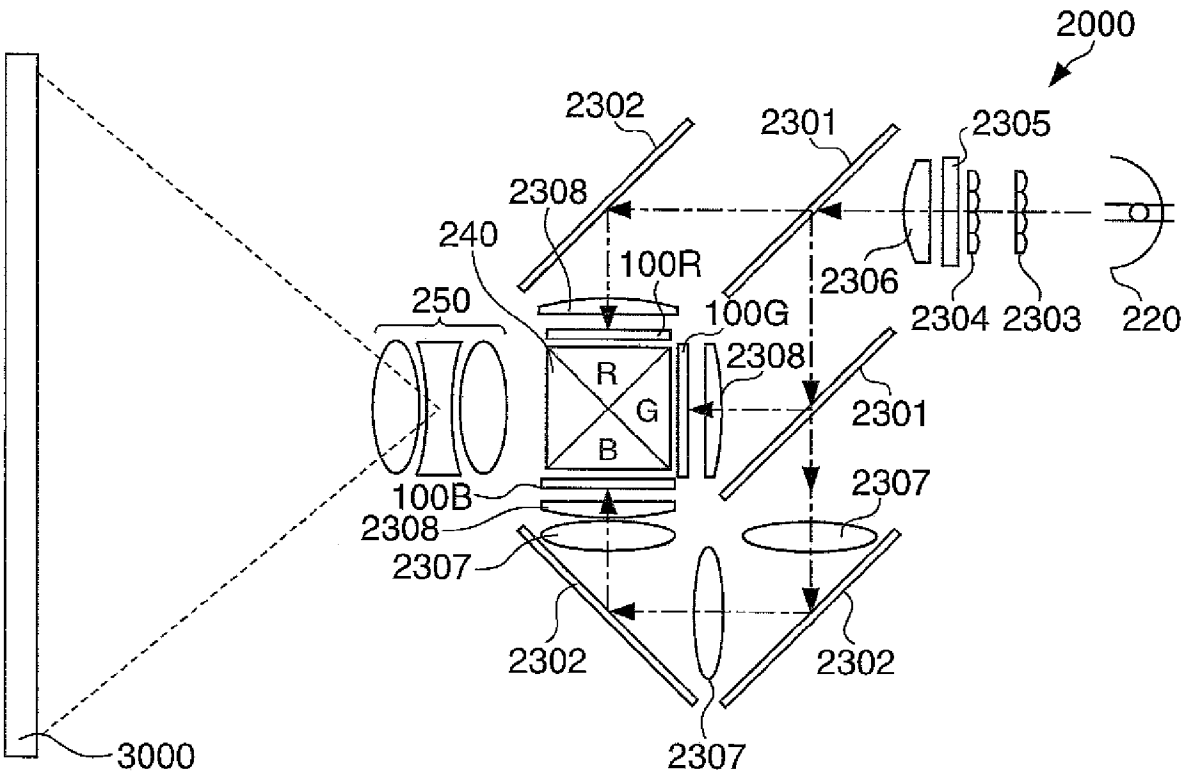
FIG. 1 is a plan view showing the configuration of a projector in an embodiment.

FIG. 1 is a plan view showing the configuration of a projector 2000 in an embodiment. The projector 2000 has a lamp unit 220 serving as a white light source such as a halogen lamp. The projected light emitted from the lamp unit 220 passes through a first multi-lens 2303, a second multi-lens 2304, a polarization conversion element 2305, and a superimposing lens 2306, and is separated into three primary colors: R (red), G (green), and B (blue) by two dichroic mirrors 2301 and three mirrors 2302. The lights obtained by separation are guided to display panels 100R, 100G, and 100B corresponding to the primary colors via condenser lenses 2308. Incidentally, the B light is guided via a relay lens system using three lenses 2307 to prevent the loss due to a longer optical path as compared to the R light and the G light.

The display panels 100R, 100G, and 100B are light valves such as liquid crystal panels that modulate lights. As will be described later, the display panels 100R, 100G, and 100B are driven individually based on SF codes obtained by converting a video signal Vid corresponding to the colors of R, G, and B by referring to an LUT (Look up Table) set for each pixel. As a result, reduced images of the colors of R, G, and B are formed in the display panels 100R, 100G, and 100B, respectively. The reduced images formed by the display panels 100R, 100G, and 100B, that is, modulated lights enter a dichroic prism 240 from three directions. Then, in the dichroic prism 240, the R light and the B light are reflected at an angle of degrees and the G light travels in a straight line. Therefore, after the images of these colors are combined, a color image is projected onto a screen 3000 by a projection lens 250.

Incidentally, since the lights corresponding to R, G, and B enter the display panels 100R, 100G, and 100B by the dichroic mirrors 2301, there is no need to provide a color filter. Moreover, while the transmission images of the display panels 100R and 100B are projected after being reflected by the dichroic prism 240, the transmission image of the display panel 100G is projected as it is. Thus, a configuration is adopted in which horizontal scanning directions by the display panels 100R and 100B are opposite to a horizontal scanning direction by the display panel 100G, whereby a mirror-reversed image is displayed.

Functional Configuration

Figure 2:
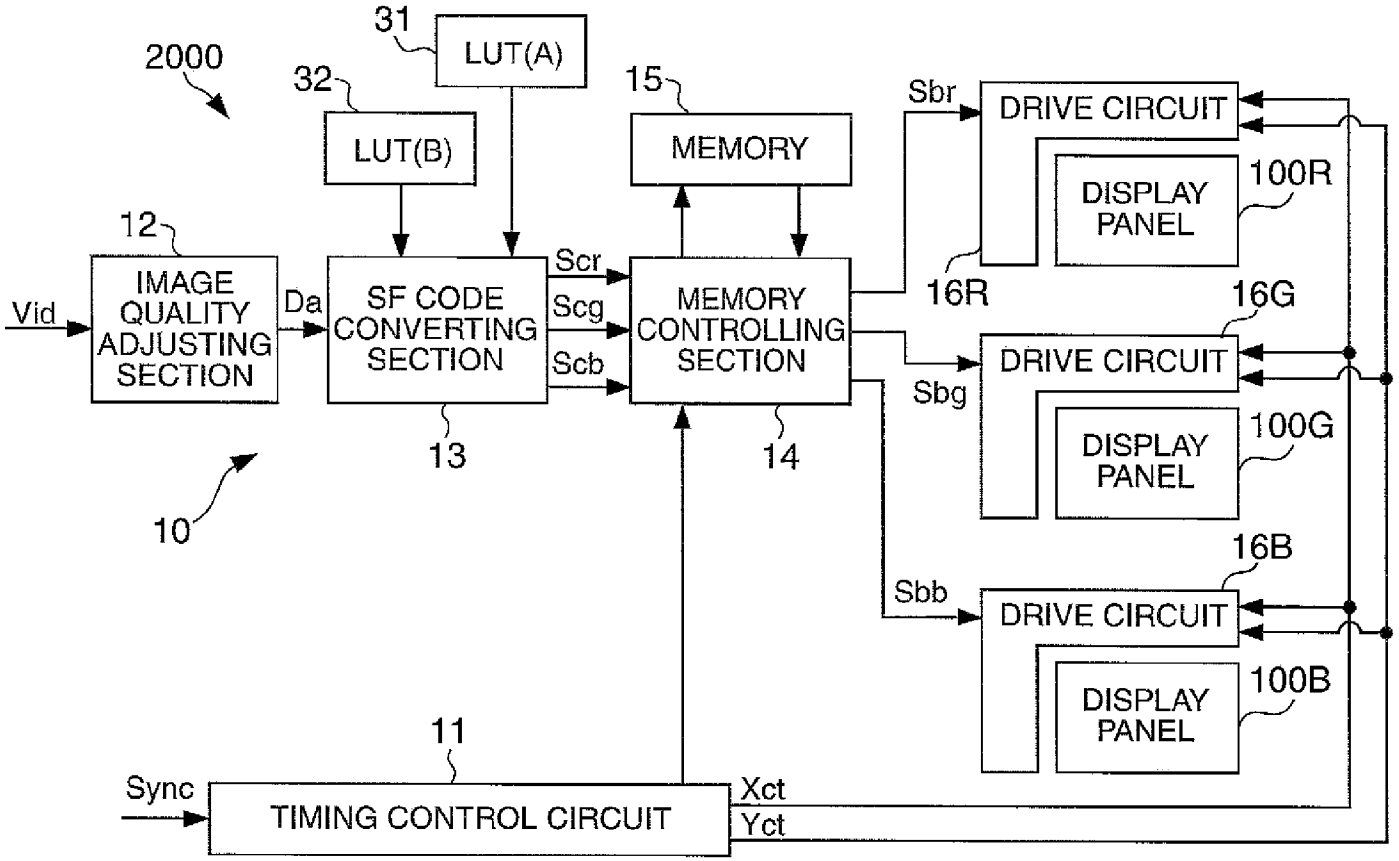
FIG. 2 is a diagram explaining the functional configuration of the projector in the embodiment.

FIG. 2 is a diagram explaining the functional configuration of the projector 2000 in the embodiment. The projector 2000 has a controller 10 which is a driving section for making the display panels 100R, 100G, and 100B form the reduced images, the display panels 100R, 100G, and 100B, and a plurality of LUTs. The controller 10 has a timing control circuit 11, an image quality adjusting section 12, an SF code converting section 13, a memory controlling section 14, a memory 15, and drive circuits 16R, 16G, and 16B. In this example, the plurality of LUTs are an LUT(A) 31 and an LUT(B) 32.

Incidentally, since the display panels 100R, 100G, and 100B are identical in configuration, these panels are collectively written as a display panel 100 when it is not necessary to distinguish them from one another in the following description.

To the controller 10, a video signal Vid and a synchronizing signal Sync are supplied from an unillustrated higher-level circuit. The video signal Vid is a signal expressing an image as three primary colors (three color components: red (R), green (G), and blue (B)). The video signal Vid defines the gray level of each pixel in the image for each of R, G, and B. Incidentally, the video signals Vid are supplied in the order of the pixels which are scanned in accordance with a vertical scanning signal, a horizontal scanning signal, etc. contained in the synchronizing signal Sync.

The timing control circuit 11 controls the individual sections based on the synchronizing signal Sync.

The image quality adjusting section 12 performs preprocessing on the brightness, hue, etc. of the image which are defined by the video signal Vid in accordance with the display characteristics of the display panel 100 and the details set by using various kinds of unillustrated operators, and outputs a processed video signal Da. Incidentally, in this example, the video signal Vid supplied from the higher-level circuit may be an analog signal or a digital signal. When the video signal Vid supplied from the higher-level circuit is an analog signal, the analog signal is converted into a digital signal by the image quality adjusting section 12.

Incidentally, in this example, the video signal Da is an 8-bit signal, and, as a gray level to be expressed in each pixel, 256 levels of gray are designated in increments of "1" from the darkest "0" to the brightest "255" in decimal notation.

The SF code converting section 13 converts the gray level of the video signal Da into SF codes Scr, Scg, and Scb for the colors of an R component, a G component, and a B component, respectively, by referring to the LUT (A) 31 and the LUT (B) 32, and outputs the SF codes Scr, Scg, and Scb. The SF code converting section 13 refers to any one of the LUT (A) 31 and the LUT(B) 32, the one which is determined in advance for each pixel. The SF codes Scr, Scg, and Scb are each formed of 32 bits obtained by repeating twice a block of 16 bits: bit c1, bit c2, . . . , and bit c16. Each bit indicates the detail of driving of the pixel in each subfield, and a subfield in which the pixel is driven so as to be turned ON is represented as "1" and a subfield in which the pixel is driven so as to be turned OFF is represented as "0". That is, the SF code indicates the details of driving of the pixel in the subfields obtained by dividing one frame into 32 subfields. Incidentally, in this example, as will be described later, it is assumed that a liquid crystal element 120 is driven in normally black mode. Therefore, the subfield in which the pixel is driven so as to be turned ON is brought into a bright state, and the subfield in which the pixel is driven so as to be turned OFF is brought into a dark state.

The memory controlling section 14 writes the SF codes Scr, Scg, and Scb into the memory 15 under the control of the timing control circuit 11. Moreover, the memory controlling section 14 reads the SF codes Scr, Scg, and Scb stored in the memory 15 under the control of the timing control circuit 11, and, of the bits of the read SF codes, outputs bits corresponding to the drive timing (the subfields) in the display panels 100 as SF bits Sbr, Sbg, and Sbb. For example, an SF bit whose drive timing in the display panel 100 is the 13th subfield is a bit c13.

Configuration of the display panel 100R and the drive circuit 16R.

Figure 3:
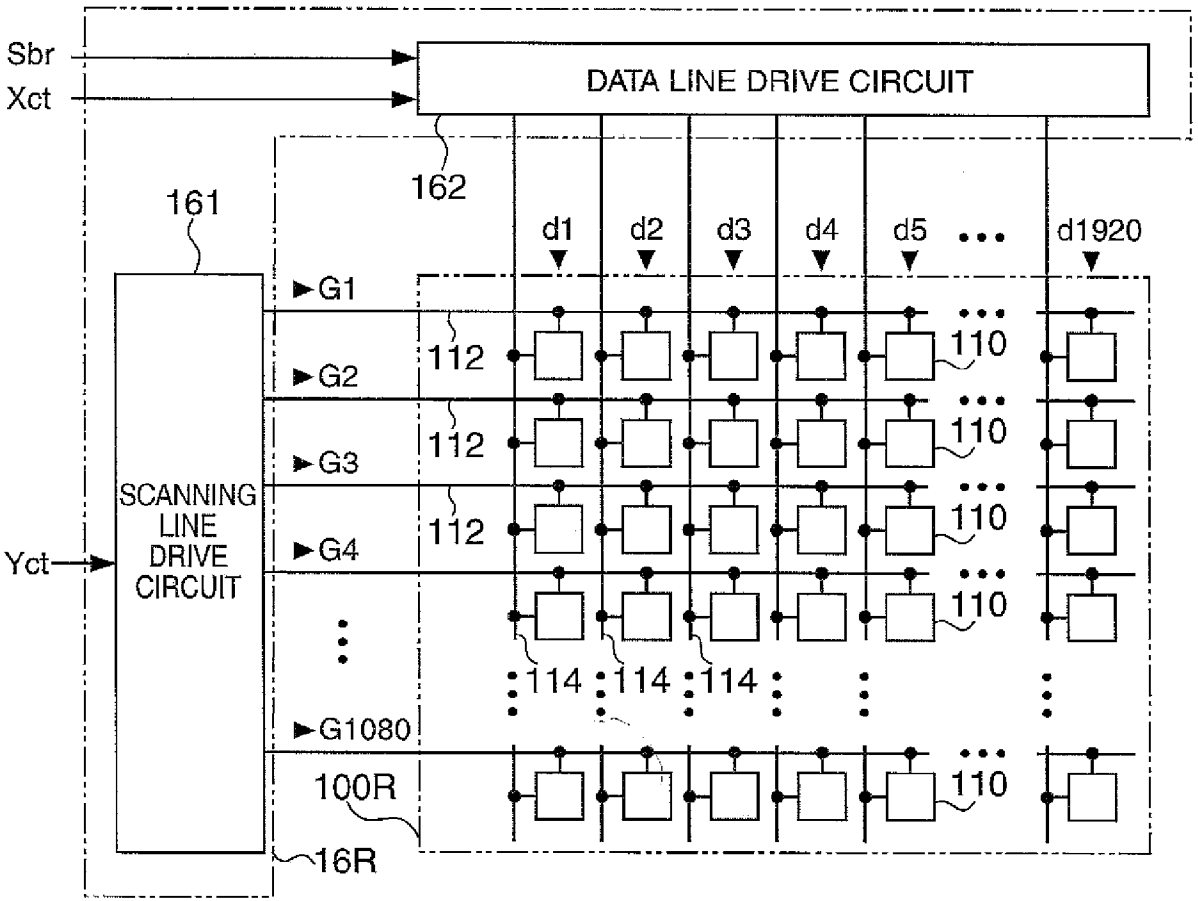
FIG. 3 is a diagram explaining the configuration of a display panel and a drive circuit in the embodiment.

FIG. 3 is a diagram explaining the configuration of the display panel 100R and the drive circuit 16R in the embodiment. The display panel 100R is, for example, an active matrix transmissive liquid crystal display panel and generates a transmission image by modulating the transmittance for each pixel.

As shown in FIG. 3, in the display panel 100R, for example, scanning lines 112 in the 1st, 2nd, 3rd, . . . , and 1080th rows are provided so as to extend in a transverse direction in the drawing, and data lines 114 in the 1st, 2nd, 3rd, . . . , and 1920th columns are provided so as to extend in a longitudinal direction in the drawing and to be electrically insulated from the scanning lines 112. In addition, at points of intersection of the scanning lines 112 of 1080 rows and the data lines 114 of 1920 columns, pixels 110 are arranged. Therefore, the pixels 110 are arranged in a matrix of 1080 rows and 1920 columns.

Around the display panel 100R, the drive circuit 16R is provided. The drive circuit 16R has a scanning line drive circuit 161 and a data line drive circuit 162. The scanning line drive circuit 161 supplies scanning signals to the scanning lines 112 in the 1st to 1080th rows. In this example, the scanning line drive circuit 161 selects the scanning line 112 in the order of the scanning lines 112 in the 1st, 2nd, 3rd, . . . , and 1080th rows by a control signal Yct supplied from the timing control circuit 11, and sets the scanning signal which is supplied to the selected scanning line at a selected voltage and the scanning signals which are supplied to the other scanning lines at a non-selected voltage, the other scanning lines which are not selected. Incidentally, in FIG. 3, the scanning signals which are supplied to the scanning lines 112 in the 1st, 2nd, 3rd, . . . , and 1080th rows are written as G1, G2, G3, . . . , and G1080, respectively.

The data line drive circuit 162 supplies a data signal to each of the data lines 114 in the 1st to 1920th columns in accordance with a control signal Xct supplied from the timing control circuit 11. The data line drive circuit 162 supplies the data signal according to the SF bit Sbr supplied from the memory controlling section 14. Incidentally, in FIG. 3, the data signals supplied to the data lines 114 in the 1st, 2nd, 3rd, . . . , and 1920th columns are written as d1, d2, d3, . . . , and d1920, respectively.

Here, the display panel 100R and the drive circuit 16R are described as an example, and, since the display panels 100G and 100B having the same configuration as the display panel 100R and the drive circuits 16G and 16B having the same configuration as the drive circuit 16R differ therefrom only in the supplied signals, their descriptions are omitted. Incidentally, the data line drive circuit 162 of the display panel 100G is supplied with the SF bit Sbg from the memory controlling section 14 and supplies a data signal according to the SF bit Sbg. Moreover, the data line drive circuit 162 of the display panel 100B is supplied with the SF bit Sbb from the memory controlling section 14 and supplies a data signal according to the SF bit Sbb.

Configuration of the Pixel 110

Figure 4:
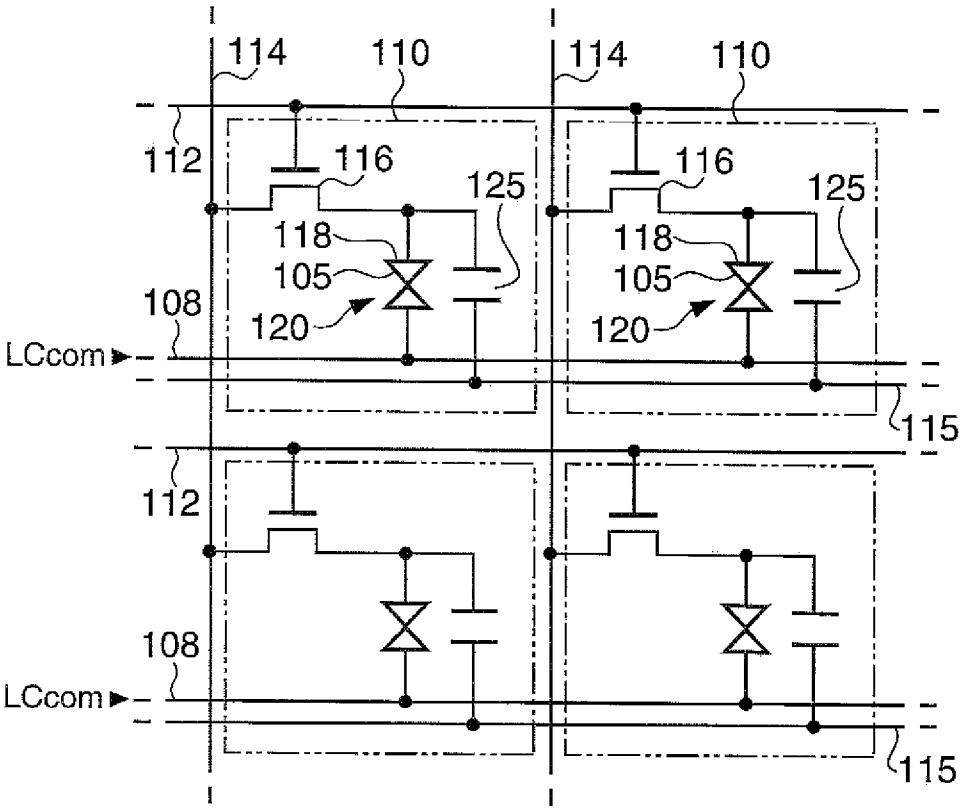
FIG. 4 is a diagram explaining an equivalent circuit of a pixel in the embodiment.

FIG. 4 is a diagram explaining an equivalent circuit of the pixel 110 in the embodiment. The pixel 110 has a liquid crystal element 120 formed of a pixel electrode 118 and a common electrode 108 between which a liquid crystal 105 is sandwiched and a thin film transistor (hereinafter referred to simply as a "TFT") 116 which is brought into conduction between the data line 114 and the pixel electrode 118 when the selected voltage is applied to the scanning line 112 and is brought out of conduction when the non-selected voltage is applied to the scanning line 112.

The common electrode 108 is shared by the pixels, and a voltage LCcom is applied to the common electrode 108 by an unillustrated circuit included in the controller 10. Moreover, in the pixel 110, an auxiliary capacitor (a storage capacitor) 125 is provided in parallel to the liquid crystal element 120. The auxiliary capacitor 125 is connected, at one end thereof, to the pixel electrode 118 and is connected, at the other end thereof, to a capacitance line 115 by common connection. The unillustrated circuit included in the controller 10 maintains the capacitance line 115 at a temporally constant voltage.

In such a configuration, in the pixel 110, when the selected voltage is applied to the scanning line 112, the TFT 116 is brought into conduction and the voltage of the data signal supplied to the data line 114 is applied to the pixel electrode 118. On the other hand, when the application of the selected voltage to the scanning line 112 is ended and the non-selected voltage is applied to the scanning line 112, the TFT 116 is brought out of conduction. However, the liquid crystal element 120 retains, by the capacitance thereof, the voltage of the data signal supplied to the pixel electrode 118 when the TFT 116 was in a conduction state until the selected voltage is applied to the scanning line 112 again.

Incidentally, since the pixel 110 is driven so as to be turned ON or OFF, the data signal is at ON level corresponding to "1" of the SF bit or OFF level corresponding to "0" of the SF bit. In this example, the liquid crystal element 120 is driven in normally black mode. Therefore, the ON level refers to a data signal by which a voltage (for example, 5V) is applied to the liquid crystal element 120 to bring the liquid crystal element 120 into a bright state, and the OFF level refers to a data signal by which no voltage is applied to the liquid crystal element 120 (or a voltage that makes the applied voltage closer to zero) to bring the liquid crystal element 120 into a dark state.

In this example, since alternating-current driving of the liquid crystal element 120 is performed, two types of ON level: a positive-polarity ON level on a higher-level side relative to an amplitude center voltage and a negative-polarity ON level on a lower-level side relative to the amplitude center voltage are required. Incidentally, when alternating-current driving is not performed, one polarity will suffice.

On the other hand, when no voltage is applied to the liquid crystal element 120, there is only one type of OFF level: the voltage LCcom which is applied to the common electrode 108, and the OFF level is independent of polarity. When alternating-current driving of the liquid crystal element 120 is performed and a voltage that makes the applied voltage closer to zero is applied, two types of OFF level: a positive-polarity OFF level and a negative-polarity OFF level relative to the amplitude center voltage are required. Incidentally, when alternating-current driving is not performed, one polarity will suffice.

Incidentally, in this description, for the voltages of the scanning signal and the data signal, though not illustrated, a ground potential GND is used as the standard with a voltage of zero. However, the applied voltage of the liquid crystal element 120 is a potential difference between the voltage LCcom of the common electrode 108 and the pixel electrode 118. Moreover, the voltage LCcom which is applied to the common electrode 108 may be assumed to be the same voltage as the amplitude center voltage. However, adjustments are sometimes made in consideration of OFF leakage etc. of the n-channel TFT 116 such that the voltage LCcom becomes lower than the amplitude center voltage.

How the Pixel 110 is Driven

Figures 5A, 5B:
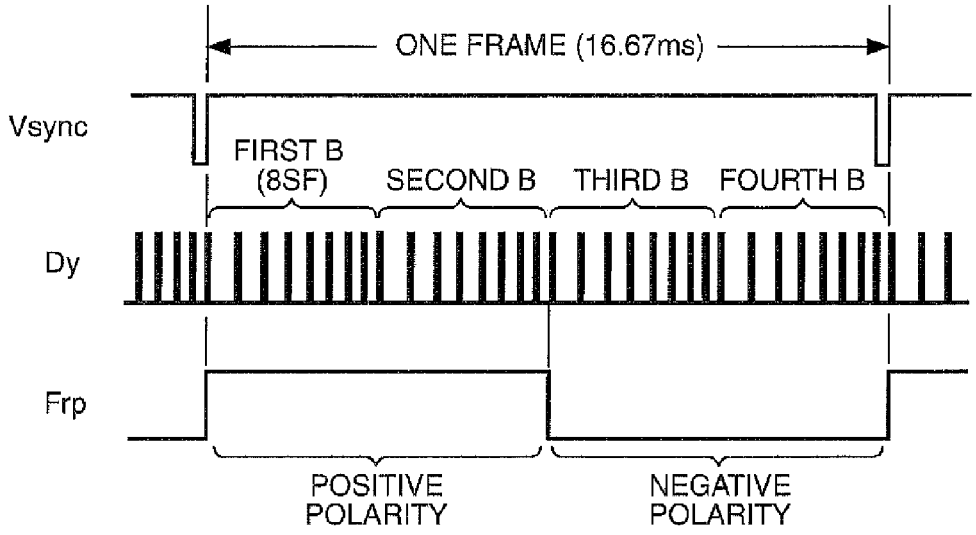
FIGS. 5A and 5B are diagrams explaining signals which are supplied to the drive circuit in the embodiment.

FIGS. 5A and 5B are diagrams explaining signals which are supplied to the drive circuits 16R, 16G, and 16B in the embodiment. Here, of the signals to be supplied, a vertical synchronizing signal Vsync and a start pulse Dy which are contained in the control signal Yct and a polarity designating signal Frp contained in the control signal Xct will be described.

As shown in FIG. 5A, the vertical synchronizing signal Vsync is a signal defining one frame that is a unit period of display. In this example, one frame corresponds to 16.67 ms (60 Hz). The polarity designating signal Frp is a signal that defines a period in which the ON level when alternating-current driving of the liquid crystal element 120 is performed is a positive-polarity ON level and a period in which the ON level is a negative-polarity ON level. With this polarity designating signal Frp, the first half of one frame is defined as a positive-polarity period and the latter half is defined as a negative-polarity period. This makes it possible to achieve a polarity balance of the voltage which is applied to the liquid crystal element 120.

The start pulse Dy is a signal that defines a period of each subfield. In this example, eight start pulses Dy as one cycle are repeated four times in one frame, and there are 32 start pulses Dy in one frame. Therefore, one frame is divided into 32 subfields. Hereinafter, eight subfields ("8SF" in FIG. 5A) in one cycle is referred to as one block, and the blocks in one frame are referred to, from the first one, as a first block, a second block, a third block, and a fourth block ("first 1B", "second 2B", "third 3B", and "fourth 4B" in FIG. 5A).

The eight pulses in one cycle in the start pulses Dy have different pulse intervals, and each interval represents a period of a subfield. Hereinafter, the subfields are referred to as SF1, SF2, . . . , and SF8. In this example, as shown in FIG. 5B, the times of SF1, SF2, . . . , and SF8 are defined as 1.40 ms, 0.90 ms, 0.70 ms, 0.50 ms, 0.32 ms, 0.20 ms, 0.10 ms, and 0.05 ms, respectively, and weights are assigned thereto. In this example, the earlier a period is in one cycle, the period in which a subfield is located, the longer the time of the subfield becomes.

Incidentally, subfield ON driving (a drive voltage at ON level is applied) or OFF driving (a drive voltage at OFF level is applied) in each pixel is performed when the scanning line is selected. Therefore, technically speaking, the start time of one frame (and each subfield) in a pixel differs from scanning line to scanning line in terms of time.

As described earlier, in the pixel 110, the ON level or the OFF level which was applied to the pixel electrode 118 when the scanning line 112 was selected is retained until the scanning line 112 is selected again. Therefore, to bring the pixel 110 into an ON or OFF driving state only in a period corresponding to a certain subfield, it is necessary simply to set, as the period corresponding to the subfield, a period between the writing of the ON level or OFF level (of the data signal) according to the SF bit into the liquid crystal element 120 after the selection of the scanning line and the re-selection of the scanning line.

Figure 6:
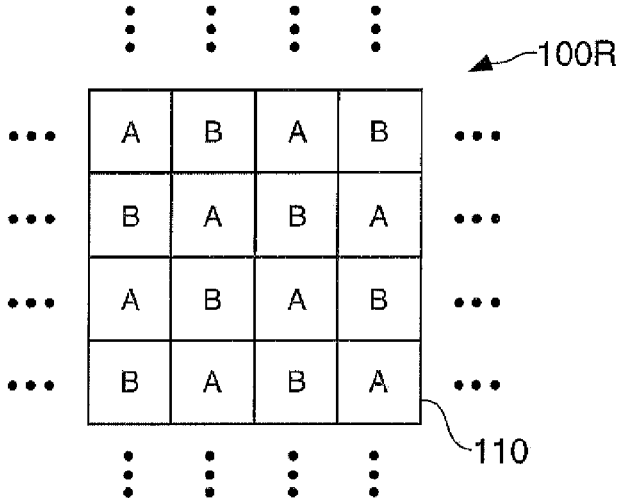
FIG. 6 is a diagram explaining LUTs which are applied to the pixels in the embodiment.

FIG. 6 is a diagram explaining the LUTs which are applied to the pixels 110 in the embodiment. As described earlier, the SF code converting section 13 converts the video signal Da into the SF code for each pixel by referring to any one of the LUT(A) 31 and the LUT(B) 32. FIG. 6 shows the LUTs which are referred to at this time, "A" indicating a pixel 110 (hereinafter referred to as a pixel 110A) which is driven based on the SF code obtained by referring to the LUT(A) 31, and "B" indicating a pixel 110 (hereinafter referred to as a pixel 110B) which is driven based on the SF code obtained by referring to the LUT (B) 32.

In this example, the pixels 110A are the pixels 110 provided at points of intersection of the scanning lines in the odd-numbered rows and the data lines in the odd-numbered columns and the pixels 110 provided at points of intersection of the scanning lines in the even-numbered rows and the data lines in the even-numbered columns. On the other hand, the pixels 110B are the pixels 110 other than the pixels 110A. That is, the pixels 110B are the pixels 110 provided at points of intersection of the scanning lines in the odd-numbered rows and the data lines in the even-numbered columns and the pixels 110 provided at points of intersection of the scanning lines in the even-numbered rows and the data lines in the odd-numbered columns. As described above, the pixels 110 are arranged in such a way that a pixel 110 adjacent to a pixel 110A is a pixel 110B. That is, the pixels 110A and the pixels 110B are arranged in a checkered pattern.

Contents of the LUT

FIGS. 7A and 7B are diagrams explaining the LUTs in the embodiment. FIG. 7A shows the LUT (A) 31, and FIG. 7B shows the LUT (B) 32. In both of FIGS. 7A and 7B, portions in which the gray levels are "50" to "80" are extracted and shown. The LUT(A) 31 and the LUT(B) 32 are each formed of 16 bits: bit c1, bit c2, . . . , and bit c16. The 8 bits: bits c1 to c8 in the first half of the 16 bits represent the details of driving of the pixel 110 in the SF1, SF2, . . . , and SF8 in the first and third blocks in one frame, and the bits c9 to c16 in the latter half of the 16 bits represent the details of driving of the pixel 110 in the SF1, SF2, . . . , and SF8 in the second and fourth blocks. Therefore, for example, the bits c1 and c9 are equal in the times of the corresponding subfields. Similarly, as for the other relationships, for example, the relationship between the bits c8 and c16, the bits c8 and c16 are equal in the times of the corresponding subfields. As described above, the LUT defines the correlation between the gray level and the SF code represented by the bits.

In principle, with a few exceptions which will be described later, the LUT defines the bits in such a way that the higher the gray level, the longer the time (hereinafter referred to as the ON time) of a bright state in which the pixel 110 is driven so as to be turned ON in one frame. As for some gray levels, in a change in the SF code when a gray level changes to such a gray level from a lower gray level next thereto, the longest subfield of the bits which have changed from "0" to "1" coincides with the longest subfield of the bits "1" in the changed SF code. For example, in the LUT(A) 31 in the range shown in FIG. 7A, such gray levels are "56", "65", and "78". Hereinafter, such gray levels are referred to as maximum weight changing sections.

Here, when the gray level is "56", in a change of the SF code from "55", the bits c8 and c11 have changed from "0" to "1", and the longest subfield is SF3 corresponding to the bit oil; on the other hand, the longest subfield of the bits "1" in the changed SF code is also SF3 (bits c3 and oil) and there is agreement between them.

In the LUT(B) 32, the maximum weight changing sections are determined so as to be gray levels that are different from those in the LUT(A) 31, and, in this example, are determined so that the gray levels in the LUT (B) 32 becomes greater than those in the LUT (A) 31 by "1". That is, the maximum weight changing sections in the LUT(B) 32 are "57", "66", and "79. Therefore, at the gray levels corresponding to the maximum weight changing sections of the LUT (A) 31 or the LUT (B) 32, the LUT(A) 31 and the LUT(B) 32 differ from each other in the SF code. Incidentally, in this example, at other gray levels, some SF codes also differ from each other in the LUT (A) 31 and the LUT (B) 32. This is to improve the gray level accuracy by using dithering. Thus, the SF code of the LUT(A) 31 may be the same as the SF code of the LUT(B) 32 at a gray level other than the gray levels corresponding to the maximum weight changing sections.

FIG. 8 is a diagram explaining the features of the maximum weight changing section in the embodiment. In FIG. 8, the gray level "65" of the maximum weight changing sections of the LUT(A) 31, the gray level "66" of the maximum weight changing sections of the LUT(B) 32, and the gray levels "64" and "67" which are next to the gray level "65" and the gray level "66", respectively, are extracted, and the features thereof are shown in detail.

As described earlier, the total ON time (the time of a bright state) is obtained by adding the times of the subfields in which the pixel 110 is driven so as to be turned ON and, in the example shown in FIG. 8, is obtained by adding the times of the subfields in the first and second blocks. Therefore, for one frame, the value has to be doubled.

As described earlier, the LUT(A) 31 and the LUT(B) 32 differ from each other in the gray level which is the maximum weight changing section. Therefore, when the gray level changes from "64" to "65", the bit c2 which changes from "0" to "1" in the LUT(A) 31 does not change in the LUT(B) 32. As a result, in the LUT(B) 32, the total ON time becomes shorter than that of the LUT(A) 31 by the time corresponding to SF2; however, the total ON time which has become shorter by the time corresponding to SF2 is increased by adjusting the bits c3 to c8 and c11 to c16 in SF3 to SF8 whose times are shorter than the time of SF2. For example, at the gray level "65", by adjusting the SF code of the LUT(B) 32 such that the bits c4, c5, and c6 are changed from "0" in the SF code of the LUT(A) 31 to "1" and the bits c8 and c16 are changed from "1" in the SF code of the LUT(A) 31 to "0", the total ON time is adjusted. By doing so, the total ON time in the LUT(A) 31 and the total ON time in the LUT(B) 32 are nearly equal at the same gray level. Incidentally, the total ON times may not be the same and may be different from each other to a certain extent. However, given the influence on display, such as checkered pattern display by the pixels 110A and the pixels 110B, when the same gray level is designated for the pixels 110 in a certain range, it is preferable that a difference between the total ON time in the LUT(A) 31 and the total ON time in the LUT(B) 32 fall within 10% of the sum of these total ON times.

Moreover, when, in the longest subfield with a bit "1" of the SF codes corresponding to the gray levels which are the maximum weight changing sections in one LUT, the bit of the SF code corresponding to the same gray level in the other LUT becomes "0" (hereinafter, the gray level in this case is referred to as a specific gray level, which is, for example, the gray level "65"), the SF codes are determined as follows. Here, in the LUT(A) 31 and the LUT(B) 32, the SF codes are determined such that the total ON time at the above-described specific gray level becomes longer than the total ON time at a higher gray level next to the specific gray level.

Incidentally, the total ON time at the above-described specific gray level is not limited to a case in which the above condition is met, and the SF codes may be determined such that the total ON time at the above-described specific gray level becomes longer than the average of the total ON time at a lower gray level next to the specific gray level and the total ON time at a higher gray level next to the specific gray level. Moreover, adjustments do not necessarily have to be performed in the manner as described above such that the total ON time at the above-described specific gray level becomes longer.

A transverse electric field generation time is the sum of the times of the subfields corresponding to different bits when the SF codes of the gray levels which are next to each other (for example, "64-65" in the drawing indicates the gray levels "64" and "65") are compared with each other. For example, the transverse electric field generation time of "64-65" in the LUT(A) 31 indicates the length of time a transverse electric field is generated, the transverse electric field generated, when the LUT (A) 31 is applied to the adjacent pixels 110, between these pixels 110 when the gray level "64" is designated for one pixel 110 and the gray level "65" is designated for the other pixel 110. That is, since the transverse electric field is generated between the adjacent pixels 110 in SF2, SF4, and SF6 of the first (third) block and in SF8 of the second (fourth) block, the transverse electric field generation time is 1.65 ms (=0.90+0.50+0.20+0.05).

Incidentally, in the example shown in FIG. 8, the transverse electric field generation time is calculated for the subfields in the first and second blocks. Therefore, for one frame, the value has to be doubled.

D risk is a parameter indicating the risk of the influence of disclination on display being visually identified, and is calculated as the ratio of the transverse electric field generation time to the total ON time. As the total ON time here, the total ON time at a higher gray level of the gray levels which are next to each other is used. For example, for "64-65", as the total ON time used for the calculation of the D risk, the total ON time at the gray level "65" is used. When the D risk exceeds 20%, the risk of the influence of disclination on display being visually identified is increased.

Thus, of the gray levels which are next to each other, the gray levels whose D risk exceeds 20%, a higher gray level may be regarded as corresponding to the maximum weight changing section described above. In this case, in the LUT (A) 31 and the LUT (B) 32, the maximum weight changing sections simply have to be determined so as to be different gray levels. Incidentally, 20% is an example of a percentage at which the risk of the influence of disclination on display being visually identified is increased and varies depending on display gradation, display panel assembly conditions, etc. For example, at a low gray level with a transmittance (corresponding to the ratio of the total ON time to the time of one frame) of 20% or less, the D risk of disclination affecting display is relaxed to 40% or more. Moreover, it is possible to make disclination unlikely to affect display by reducing the thickness of a liquid crystal layer of the display panel. That is, the value of the D risk may be set at a value other than 20% depending on the influence of disclination on display.

Drive Operation

Next, the operations of the component elements when the pixels 110 are driven will be described with reference again to FIGS. 2, 3, and 4.

The SF code converting section 13 converts the video signal Da supplied from the image quality adjusting section 12 into SF codes. At this time, the SF code converting section 13 performs conversion into SF codes for a gray level of the video signal Da, the gray level designated for the pixel 110A, by referring to the LUT(A) 31, and performs conversion into SF codes for a gray level of the video signal Da, the gray level designated for the pixel 110B, by referring to the LUT(B) 32. Then, the SF code converting section 13 outputs, to the memory controlling section 14, the SF codes Scr, Scg, and Scb converted from the video signal Da so as to correspond to the colors, and the SF codes Scr, Scg, and Scb are written into the memory 15 by the memory controlling section 14.

For example, when, a gray level designated for a certain pixel 110A is "66" in the video signal Da, the gray level is converted into an SF code corresponding to the gray level "66" in the LUT(A) 31, that is, a 32-bit code in which "0110000000111110" corresponding to bits c1 to c16 is repeated twice, and the code is written into the memory 15 by the memory controlling section 14.

On the other hand, based on the input synchronizing signal Sync, the timing control circuit 11 supplies the control signals Xct and Yct to the drive circuits 16R, 16G, and 16B. As described earlier, the control signal Yct contains the vertical synchronizing signal Vsync, the start pulse Dy, and a clock signal for transferring the start pulse Dy, and is supplied to the scanning line drive circuit 161. The scanning line drive circuit 161 outputs operation signals G1, G2, . . . , and G1080 by, for example, transferring the start pulse Dy in accordance with the clock signal described above. As a result, each scanning line 112 is repeatedly selected/not selected in accordance with the period of the subfield defined by the start pulse Dy.

The SF bits Sbr, Sbg, and Sbb are supplied to the data line drive circuits 162 as a result of the memory controlling section 14 reading, under the control of the timing control circuit 11, the SF bits Sbr, Sbg, and Sbb in one row corresponding to the pixels 110 in the 1st to 1920th columns in each row before the selection of the scanning line in each row.

The memory controlling section 14 selects any one bit of the read SF code Scr in accordance with the current drive timing (subfield) of the display panel 100R and outputs the one bit. Moreover, the memory controlling section 14 selects any one bit of the read SF code Scg in accordance with the current drive timing (subfield) of the display panel 100G and outputs the one bit, and selects any one bit of the read SF code Scb in accordance with the current drive timing (subfield) of the display panel 100B and outputs the one bit.

Incidentally, the timing control circuit 11 supplies, to the memory controlling section 14, the number of outputs of the start pulse Dy in the frame defined by the vertical synchronizing signal Vsync as information indicating the current subfield of the display panel 100. This enables the memory controlling section 14 to determine the current drive timing (subfield) of the display panel 100.

Before the scanning line in a certain row is selected by each scanning line drive circuit 161, the SF codes Scr, Scg, and Scb of the row are read from the memory 15, and the SF bits Sbr, Sbg, and Sbb are supplied to the data line drive circuits 162. As a result, before the selection of the scanning line, the data line drive circuits 162 are supplied with the SF bits Sbr, Sbg, and Sbb which correspond to the pixels in the 1st to 1920th columns corresponding to the scanning line and correspond to the subfield in which writing is to be performed in this selection.

The data line drive circuits 162 of the display panels 100R, 100G, and 100B convert the SF bits of the one row into a data signal at ON level or OFF level with a polarity designated by the polarity designating signal Frp contained in the control signal Xct, and supply the data signal to the data lines 114 in the 1st to 1920th columns when the scanning line in the row is selected.

When the scanning line in the row is selected, the data signals supplied to the data lines 114 are applied to the pixel electrodes 118 of the liquid crystal elements 120 as a result of the TFTs 116 corresponding to the row being brought into conduction, whereby the liquid crystal elements 120 are driven so as to be turned ON or OFF in accordance with the designated polarity.

Incidentally, when the selection of the scanning line is ended, the TFTs 116 are brought out of conduction. However, since the liquid crystal elements 120 each retain, by the capacitance of the liquid crystal element and the auxiliary capacitor 125, the voltage which was applied to the pixel electrodes 118 when the TFTs 116 were in a conduction state, the liquid crystal elements 120 are maintained in ON or OFF driving state until the scanning line is selected again.

Such an operation is performed on the 1st to 1080th rows in order in one subfield. Furthermore, the operation in one subfield is performed in the order of the subfields SF1 to SF8, and the operation performed in the order of the subfields SF1 to SF8 is repeated four times in one frame.

As a result, each pixel is driven so as to be turned ON or OFF in accordance with the SF bit in each subfield, and the average transmittance when one frame is regarded as a unit period takes a value commensurate with the gray level, whereby gradation is expressed.

Display Examples

Figure 9A:
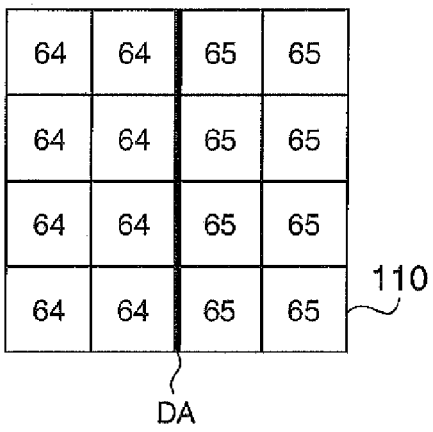
FIGS. 9A and 9B are diagrams explaining how disclination is generated in the embodiment.
Figure 9B:
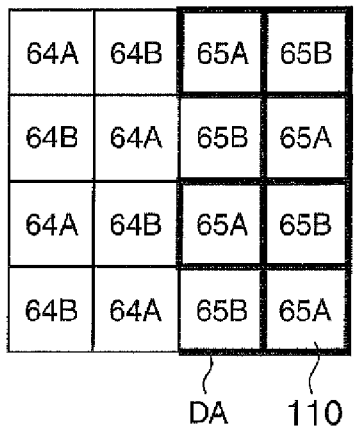

FIGS. 9A and 9B are diagrams explaining how disclination is generated in the embodiment. In FIGS. 9A and 9B, display examples in which, in 16 pixels 110 in a certain range of the display panel 100, a gray level "64" is designated for the pixels 110 in the left side and a gray level "65" is designated for the pixels 110 in the right side are shown. FIG. 9A shows a case in which, as in an existing example, different LUTs are not used, for example, a case in which the pixels 110 are driven by referring only to the LUT (A) 31. The characters "64" and "65" in the drawing represent the gray levels designated for the pixels 110. FIG. 9B shows a case in which, as in the embodiment of the invention, the pixels 110A are driven by referring to the LUT(A) 31 and the pixels 110B are driven by referring to the LUT(B) 32. The characters "64A" and "64B" in the drawing represent the pixels 110A and 110B whose designated gray level is "64", and the characters "65A" and "65B" represent the pixels 110A and 110B whose designated gray level is "65".

In the existing example, as shown in FIG. 9A, the D risk is increased on the border between the gray levels "64" and "65" and linear disclination DA is generated. On the other hand, in the embodiment of the invention, as shown in FIG. 9B, disclination DA is generated on the borders between "64B" and "65A" and between "65A" and "65B". As described above, in the embodiment of the invention, as compared to the existing example in which the disclination DA is concentrated in the portion corresponding to the border between the gray levels which are next to each other, the disclination DA is made less noticeable by being spatially spread, which makes it possible to reduce the influence on display.

Moreover, as shown in FIG. 9B, in a region in which "65" is designated as the gray level (a region for which a specific gray level is designated), since the disclination DA is generated throughout much of the region, the transmittance is decreased as compared to a case in which the disclination DA is not generated. Here, as described earlier, the total ON time is made to become longer when, in the longest subfield with a bit "1" of the SF codes corresponding to the gray levels which are the maximum weight changing sections in one LUT, the bit of the SF code corresponding to the same gray level in the other LUT is "0", that is, at a specific gray level. As also shown in FIG. 8, since the gray level "65" is a gray level at which the total ON time is made to become longer, it is possible to offset the transmittance decreased due to the generation of the disclination DA by increasing the total ON time and perform display with a transmittance closer to the original gray level.

Modified Examples

While the embodiment of the invention has been described, the invention can be practiced in various ways as follows.

Modified Example 1

In the embodiment described above, the LUT which is referred to when the pixel 110 is driven may be changed to another LUT on a frame-by-frame basis. In this case, the SF code converting section 13 simply has to determine the LUT which is referred to such that the positional relationship between the pixels 110A and the pixels 110B is changed on a frame-by-frame basis.

Figure 10A:
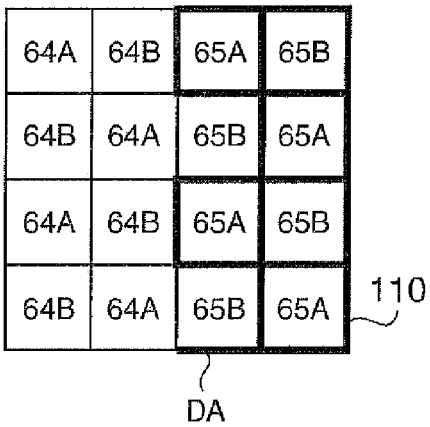
FIGS. 10A and 10B are diagrams explaining how disclination is generated in Modified Example 1.
Figure 10B:
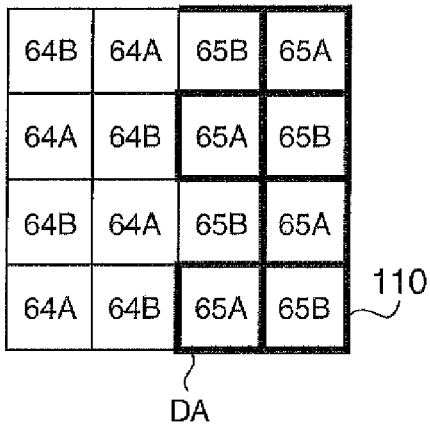

FIGS. 10A and 10B are diagrams explaining how disclination is generated in Modified Example 1. FIG. 10A shows how disclination DA is generated in an odd-numbered frame, and FIG. 10B shows how disclination DA is generated in an even-numbered frame. In this way, the disclination DA is made less noticeable as a result of the position of the disclination DA changing on a frame-by-frame basis and the disclination DA being also temporally spread. This makes it possible to reduce the influence on display.

Incidentally, the LUT may be changed to another LUT once every two or more frames, not on a frame-by-frame basis.

Modified Example 2

In the embodiment described above, as shown in FIG. 6, the pixels 110A and the pixels 110B are arranged in a checkered pattern. However, the pixels 110A and the pixels 110B may be arranged in other patterns.

FIGS. 11A and 11B are diagrams explaining the LUTs which are applied to the pixels 110 in Modified Example 2. As shown in FIG. 11A, the arrangement of the pixels 110A to which the LUT (A) 31 is applied and the pixels 110B to which the LUT (B) 32 is applied is not limited to an arrangement in which equal numbers of pixels 110A and pixels 110B are arranged, and an arrangement in which the number of pixels 110A is greater than the number of pixels 110B or the number of pixels 110B is greater than the number of pixels 110A may be adopted. That is, it is necessary simply to apply an LUT to at least one pixel 110, the LUT which is different from an LUT applied to the other pixels 110. Moreover, as shown in FIG. 11B, the pixels 110A and the pixels 110B may be arranged randomly. At this time, the pixels 110A and the pixels 110B may be arranged in such a way that the number of pixels 110A and the number of pixels 110B in a certain range are equal to each other.

As described above, it is necessary simply to dispose the pixels 110A and the pixels 110B so as to be distributed such that disclination is spatially spread.

Modified Example 3

In the embodiment described above, the maximum weight changing section of the LUT (A) 31 and the maximum weight changing section of the LUT(B) 32 are gray levels which are next to each other. However, the maximum weight changing section of the LUT (A) 31 and the maximum weight changing section of the LUT (B) 32 may be set at gray levels different from each other by 2 levels or more.

Modified Example 4

In the embodiment described above, two LUTs: the LUT (A) 31 and the LUT(B) 32 have been used. However, three or more LUTs may be used.

Modified Example 5

In the embodiment described above, one frame is formed of four blocks, each having eight subfields as one cycle, but the embodiment is not limited thereto. One frame may be formed of five or more blocks or one block. Here, when the SF codes defined by the LUT are defined as the SF codes for the subfields of a plurality of blocks, as described in the embodiment, settings may be made such that the long subfields in the blocks do not change from OFF to ON concurrently when the gray level changes to a higher gray level next thereto. By doing so, it is also possible to reduce the D risk and thereby reduce the influence of disclination on display.

Modified Example 6

In the embodiment described above, one frame is formed of 32 subfields, but the number of subfields is not limited to 32. Moreover, the SF code defined by the LUT is 16 bits, but the number of bits is not limited to 16.

Modified Example 7

In the embodiment described above, the display panel 100 is a transmissive display panel, but the display panel 100 may be a reflective display panel. Furthermore, the driving of the liquid crystal element 120 is not limited to driving in normally black mode and may be driving in normally white mode. Here, when the liquid crystal element 120 is driven in normally white mode, the ON level refers to a data signal that brings the liquid crystal element 120 into a dark state by applying a voltage thereto, and the OFF level refers to a data signal that brings the liquid crystal element 120 into a bright state. Incidentally, when the liquid crystal element 120 is driven in normally white mode, "1" and "0" of the bits in the SF codes in the LUT described above simply have to be reversed. That is, the ON time which is the time of the bright state in the embodiment (normally black mode) corresponds to the OFF time which is the time of the bright state in normally white mode. However, "1" and "0" of the bits are not simply reversed, and the details of the SF codes are changed in the following respects.

When a sufficient ON voltage is not applied to the pixels due to the influence of the transverse electric field, disclination is generated. Therefore, when disclination is generated in normally white mode, the transmittance is increased as compared to a case in which disclination is not generated. Thus, it is necessary simply to offset the transmittance increased due to the disclination generated when a specific gray level is designated for the pixels 110 in a certain range in the same manner as in normally black mode. That is, in the case of the normally black mode described in the embodiment, the transmittance decreased due to the disclination is offset by increasing the time of the bright state by increasing the total ON time at a specific gray level. On the other hand, in the case of the normally white mode, the transmittance increased due to the disclination is offset by increasing the time of the dark state by increasing the total ON time at a specific gray level. By doing so, even in normally white mode, it is possible to perform display with a transmittance closer to the original gray level.

Modified Example 8

In the embodiment described above, the times of the subfields in one block are different from one another. However, some of the times may be the same, and the time of at least one subfield simply has to be different from the times of the other subfields.

Modified Example 9

The embodiment described above deals with a case in which the display panel 100 is used in the projector 2000, but the display panel 100 may be used also in a direct-view-type liquid crystal display. That is, the display panel 100 can be applied to any device as long as the device functions as an electrooptical device using a liquid crystal element. Moreover, the electrooptical device can also be used in various kinds of electronic apparatuses. The electronic apparatuses include a television, viewfinder-type and monitor direct-view-type video tape recorders, a car navigation device, a pager, an electronic organizer, an electronic calculator, a word processor, a work station, a videophone, a POS terminal, a digital still camera, a cellular telephone, a device provided with a touch panel, and the like.

The entire disclosure of Japanese Patent Application No. 2011-091941, filed Apr. 18, 2011 is expressly incorporated by reference herein.

What is claimed is:

1. An electrooptical device comprising:

a plurality of pixels, each having a liquid crystal element; and a driving section that drives the pixel, in accordance with a gray level designated for the pixel, in such a way that the pixel is brought into a bright state or a dark state in each of subfields obtained by dividing one frame, wherein the time of at least one subfield in one frame is different from the times of the other subfields, when a specific gray level is designated for the plurality of pixels, the driving section drives the pixels in such a way that details of driving of at least one pixel and a pixel adjacent to the one pixel, the details of driving in one frame, are different from each other, and the specific gray level is a gray level at which, when a gray level darker than the specific gray level, the gray level next to the specific gray level, changes to the specific gray level, in the details of driving of the one pixel, the ratio of the sum of the times of the subfields whose details of driving have changed to the sum of the times of the subfields whose changed details of driving indicate the bright state is more than or equal to a predetermined ratio, and, in the details of driving of the pixel adjacent to the one pixel, the ratio of the sum of the times of the subfields whose details of driving have changed to the sum of the times of the subfields whose changed details of driving indicate the bright state is not more than or equal to the predetermined ratio.

2. The electrooptical device according to claim 1, wherein the liquid crystal element is driven in normally black mode, and the time of the bright state in one frame at the specific gray level is determined so as to be longer than the average of the times of the bright state in one frame at a gray level darker than the specific gray level and a gray level brighter than the specific gray level, the gray levels which are next to the specific gray level.

3. The electrooptical device according to claim 1, wherein the liquid crystal element is driven in normally white mode, and the time of the bright state in one frame at the specific gray level is determined so as to be shorter than the average of the times of the bright state in one frame at a gray level darker than the specific gray level and a gray level brighter than the specific gray level, the gray levels which are next to the specific gray level.

4. The electrooptical device according to claim 1, wherein the liquid crystal element is driven in normally black mode, and the time of the bright state in one frame at the specific gray level is determined so as to be longer than the time of the bright state in one frame at a gray level brighter than the specific gray level, the gray level next to the specific gray level.

5. The electrooptical device according to claim 1, wherein the liquid crystal element is driven in normally white mode, and the time of the bright state in one frame at the specific gray level is determined so as to be shorter than the time of the bright state in one frame at a gray level darker than the specific gray level, the gray level next to the specific gray level.

6. The electrooptical device according to claim 1, wherein the driving section drives the pixels in such a way that the position of the at least one pixel in the plurality of pixels is changed on a frame-by-frame basis or once every two or more frames.

7. The electrooptical device according to claim 1, wherein when the specific gray level is designated for the plurality of pixels, the driving section drives all the pixels in such a way that the details of driving of one pixel in one frame are different from the details of driving of a pixel adjacent to the one pixel.

8. The electrooptical device according to claim 1, wherein when the specific gray level is designated for the plurality of pixels, the driving section drives the pixels in such a way that a difference between the time of the bright state in the at least one pixel and the time of the bright state in the pixel adjacent to the one pixel falls within 10% of the sum of the times.

* * * * *